US010586474B2

(12) United States Patent
Klages et al.

(10) Patent No.: US 10,586,474 B2
(45) Date of Patent: Mar. 10, 2020

(54) METHOD FOR ATTACHING MARKING LABELS TO A PLURALITY OF ELECTRICAL DEVICES WHICH CAN BE ARRANGED ON A SUPPORT RAIL

(71) Applicant: Phoenix Contact GmbH & Co. KG, Blomberg (DE)

(72) Inventors: Kilian Klages, Detmold (DE); Nicole Probach, Blomberg (DE); Christian Grossmann, Detmold (DE); Bernd Naguschewski, Detmold (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 16/070,525

(22) PCT Filed: Jan. 17, 2017

(86) PCT No.: PCT/EP2017/050879
§ 371 (c)(1),
(2) Date: Jul. 17, 2018

(87) PCT Pub. No.: WO2017/125385
PCT Pub. Date: Jul. 27, 2017

(65) Prior Publication Data

US 2019/0027070 A1 Jan. 24, 2019

(30) Foreign Application Priority Data

Jan. 18, 2016 (DE) ..... 10 2016 100 722
Apr. 22, 2016 (DE) ..... 10 2016 107 459

(51) Int. Cl.
*G09F 7/10* (2006.01)
*B41M 5/24* (2006.01)
(Continued)

(52) U.S. Cl.
CPC ..... *G09F 7/10* (2013.01); *B41J 2/442* (2013.01); *B41J 3/4073* (2013.01); *B41M 5/24* (2013.01);
(Continued)

(58) Field of Classification Search
CPC . G09F 7/01; G09F 3/205; B41J 3/4073; B41J 2/442; B41M 5/24; B41M 5/26
See application file for complete search history.

(56) References Cited

U.S. PATENT DOCUMENTS 3,496,521 A * 2/1970 Hohorst ..... H01R 9/26 439/716
3,824,553 A * 7/1974 Glover ..... H01R 9/26 439/717
(Continued)

FOREIGN PATENT DOCUMENTS

DE 1857546 U 8/1962
DE 1956966 U 3/1967
(Continued)

OTHER PUBLICATIONS

Helmut Hügel, et al., "Laser in der Fertigung", Technische Optik, Lasertechnologie, Dec. 2009, pp. 1-9.

*Primary Examiner* — Cassandra Davis
(74) *Attorney, Agent, or Firm* — Leydig, Voit & Mayer, Ltd.

(57) ABSTRACT

A method for the attachment of marking labels to a plurality of electrical devices that can be arranged on a support rail, each having a marking field to which a marking label that can be inscribed can be secured, the electrical devices being arranged side by side in a row along a longitudinal direction to provide an assembly, such that the marking fields of the electrical devices connect to one another along the longitudinal direction, and form a continuous row extended along the longitudinal direction, includes: attaching a marking
(Continued)

strip, having a plurality of marking labels which are associated with the marking fields of the electrical devices and which can be inscribed using a laser inscription device, along the row of electrical devices; and separating the marking labels, such that at least one marking label is arranged on the marking field of each electrical device.

7 Claims, 8 Drawing Sheets

(51) Int. Cl.

| | |
|---|---|
| ***B41M 5/26*** | (2006.01) |
| ***B41J 2/44*** | (2006.01) |
| ***G09F 3/20*** | (2006.01) |
| ***B41J 3/407*** | (2006.01) |
| ***G09F 3/00*** | (2006.01) |
| ***G09F 7/00*** | (2006.01) |

(52) U.S. Cl.
CPC ..... *B41M 5/26* (2013.01); *G09F 3/00* (2013.01); *G09F 3/205* (2013.01); *G09F 7/00* (2013.01)

(56) References Cited

U.S. PATENT DOCUMENTS

| | | | | |
|---|---|---|---|---|
| 4,564,739 | A | 1/1986 | Mattelin | |
| 5,993,267 | A | 11/1999 | Lin | |
| 8,517,758 | B2 * | 8/2013 | Pizzi | H01R 9/2683 439/491 |
| 2006/0051604 | A1 | 3/2006 | Koops et al. | |
| 2009/0104415 | A1 | 4/2009 | Schmajew | |
| 2011/0104960 | A1 | 5/2011 | Feye-Hohmann | |
| 2011/0183542 | A1 | 7/2011 | Pizzi | |
| 2011/0279841 | A1 | 11/2011 | Reibke | |
| 2013/0152440 | A1 | 6/2013 | Poelker | |
| 2013/0205566 | A1 | 8/2013 | Ruppert | |
| 2017/0011663 | A1 | 1/2017 | Hilmstedt et al. | |
| 2017/0054231 | A1 * | 2/2017 | Adams | B31D 1/02 |
| 2017/0282431 | A1 | 10/2017 | Speith et al. | |
| 2019/0009573 | A1 * | 1/2019 | Grossmann | B41M 5/26 |

FOREIGN PATENT DOCUMENTS

| | | | |
|---|---|---|---|
| DE | 6927061 | U | 12/1969 |
| DE | 3333386 | A1 | 4/1985 |
| DE | 10009750 | A1 | 9/2001 |
| DE | 20303475 | U1 | 5/2003 |
| DE | 10213110 | A1 | 10/2003 |
| DE | 102005053566 | A1 | 5/2007 |
| DE | 102006019118 | A1 | 10/2007 |
| DE | 202008010347 | U1 | 10/2008 |
| DE | 102008032837 | A1 | 1/2010 |
| DE | 102009017999 | A1 | 5/2010 |
| DE | 102010034993 | A1 | 5/2010 |
| DE | 102009056713 | A1 | 6/2011 |
| DE | 102013113328 | A1 | 6/2011 |
| DE | 102010022690 | A1 | 12/2011 |
| DE | 102010047369 | A1 | 4/2012 |
| DE | 102013112789 | A1 | 5/2015 |
| DE | 102013012389 | B4 | 10/2015 |
| DE | 102015109020 | A1 | 3/2016 |
| EP | 1622223 | A1 | 2/2006 |
| EP | 2792499 | A1 | 10/2014 |
| EP | 2391999 | B1 | 3/2015 |
| JP | S 5352442 | A | 5/1978 |
| JP | H 09220686 | A | 8/1997 |
| SU | 967462 | A1 | 10/1982 |
| WO | WO 9747397 | A1 | 12/1997 |
| WO | WO 2010057768 | A1 | 5/2010 |

* cited by examiner

METHOD FOR ATTACHING MARKING LABELS TO A PLURALITY OF ELECTRICAL DEVICES WHICH CAN BE ARRANGED ON A SUPPORT RAIL

CROSS-REFERENCE TO A RELATED APPLICATION

This application is a U.S. National Phase application under 35 U.S.C. § 371 of International Application No. PCT/EP2017/050879, filed on Jan. 17, 2017, and claims benefit to German Patent Application No. DE 10 2016 100 722.6, filed on Jan. 18, 2016, and to German Patent Application No. DE 10 2016 107 459.4, filed on Apr. 22, 2016. The International Application was published in German on Jul. 27, 2017 as WO 2017/125385 under PCT Article 21(2).

FIELD

The invention relates to a method for the attachment of marking labels to a plurality of electrical devices that can be arranged on a support rail and to a marking strip and an assembly comprising a plurality of electrical devices that can be arranged on a support rail.

BACKGROUND

A method of this type is employed for the attachment of marking labels to a plurality of electrical devices that can be arranged on a support rail, each having a marking field to which a marking label that can be inscribed can be secured. According to the method, the electrical devices are arranged side by side in a row along a longitudinal direction to provide an assembly, such that the marking fields of the electrical devices connect to one another along the longitudinal direction, and form a continuous row extended along the longitudinal direction.

An assembly of this type is known, for example, from DE 10 2013 112 789 A1, and specifically comprises a plurality of electrical devices in the form of "series terminals". The electrical devices are arranged on a transport mounting in the form of a carrier strip, and can be transported in a thus pre-assembled state and employed in an automatic placement machine for the population of a support rail.

Electrical devices which can be fitted to a support rail, for example series terminals, or electronic devices which are employed for the execution of control or automation functions for example in an industrial installation can, for example, be mutually combined in a switchgear cabinet and, to this end, can be fitted to a support rail which is arranged in the switchgear cabinet, thus providing an electrical installation within said switchgear cabinet.

In order to identify the individual electrical devices, and to provide, for example, a clear arrangement for the connection of electrical conductors by a user, it is customary for marking labels to be affixed to the electrical devices. Whereas, nowadays, automatic machines are employed for the population of support rails, for example with series terminals, of the type known, for example, from DE 10 2010 047 369 A1, identification of the electrical devices fitted to a support rail is still generally executed by manual means, wherein previously inscribed marking labels are affixed to the electrical devices. This is a laborious process and, moreover, can be prone to error.

From DE 10 2013 012 389 B4, an apparatus is known for the insertion of an identification label into a groove-shaped latching recess in a series terminal. By means of this apparatus, an inscribed identification label can be compressed into an assigned latching recess of a series terminal using an assembly punch.

From EP 2 391 999 B1, an identification label is known which, by means of a profile section, can be inserted in a recess in a series terminal in a form-fitted manner.

A further apparatus for the identification of switchgear series terminals is known from DE-U 1 857 546.

SUMMARY

In an embodiment, the present invention provides a method for the attachment of marking labels to a plurality of electrical devices that can be arranged on a support rail, each having a marking field to which a marking label that can be inscribed can be secured, the electrical devices being arranged side by side in a row along a longitudinal direction to provide an assembly, such that the marking fields of the electrical devices connect to one another along the longitudinal direction, and form a continuous row extended along the longitudinal direction, the method comprising: attaching a marking strip, having a plurality of marking labels which are associated with the marking fields of the electrical devices and which are configured to be inscribed using a laser inscription device, along the row of electrical devices; and separating the marking labels, such that at least one marking label is arranged on the marking field of each electrical device.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1A:
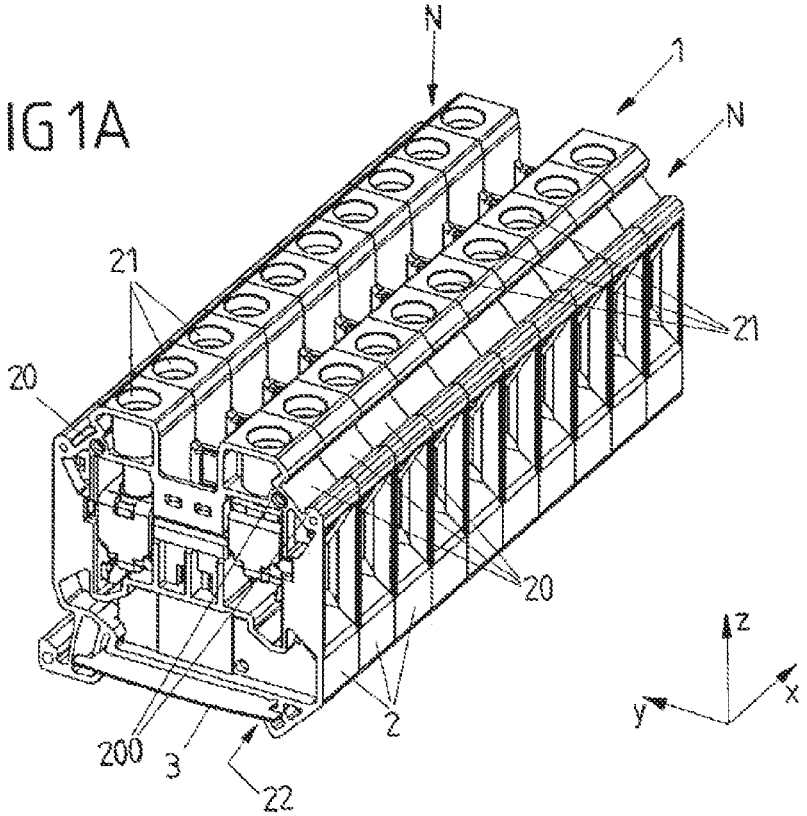
FIG. 1A shows a perspective view of an assembly of electrical devices in the form of series terminals.

In embodiments, the present invention provides a method for the attachment of marking labels to electrical devices, together with a marking strip and an assembly of electrical devices, which enable the inscription of electrical devices, for example series terminals, in a simple and automatable manner.

Accordingly, the method for the attachment of marking labels comprises the following steps:

attachment of a marking strip, having a plurality of marking labels which are associated with the marking fields of the electrical devices and which can be inscribed using a laser inscription device, along the row of electrical devices, and separation of the marking labels, such that at least one marking label is arranged on the marking field of each electrical device.

The method envisaged constitutes a departure from conventionally known methods for the inscription of electrical devices which are to be arranged on a support rail. Thus, in the context of the method, electrical devices to which inscribable marking labels are to be affixed are firstly combined to form an assembly and, to this end, are arranged side by side in a row, such that marking fields of the electrical devices connect to one another along a longitudinal direction, and form a continuous row extended along the longitudinal direction. Along this row a (continuous) marking strip can thus be secured, which comprises a plurality of inscribable marking labels. The marking labels are applied to the row of electrical devices such that one (or more) marking labels is (are) assigned to each marking field of an electrical device. Further to the application of the marking strip, the marking labels are separated, such that one or more marking labels remain(s) on the marking field of each electrical device.

The marking labels arranged on the marking fields of the electrical devices can be inscribed by means of a laser inscription device. This can be executed before or after the fitting of the electrical devices to a support rail.

Thus, by means of the method, marking labels are firstly applied to a plurality of electrical devices in a manner which is simple to automate, wherein said marking labels are only inscribed thereafter by means of a laser inscription device. The inscription can be executed, for example, with the electrical devices already fitted to a support rail and combined with other electrical devices, wherein a laser beam of the laser inscription device is controlled such that an appropriate and individual inscription is applied to the individual marking labels of the electrical devices in a specific manner.

Accordingly, the electrical devices are initially supplied with uninscribed marking labels, and can be supplied as such and fitted to a support rail in this condition. Inscription is only executed after fitting to the support rail, which can reduce the susceptibility of the inscription process to errors.

The marking strip can preferably be adhered to the electrical devices along the row of marking fields. To this end, the marking strips on the marking labels can incorporate an adhesive layer, which forms an adhesive bond with the electrical devices, and by means of which the marking labels are individually secured to the respective associated marking fields on the electrical devices.

In one specific configuration, the marking fields of the electrical devices can be arranged in recesses on said electrical devices. The recesses on the electrical devices, where the electrical devices are arranged side by side in a row, constitute a groove which extends longitudinally in the longitudinal direction, into which the marking strip can be inserted, in order to secure the marking strip to the electrical devices. The marking fields to which the marking labels of the marking strip are to be affixed can, for example, be configured here on the base of the recesses in the electrical devices, wherein it is conceivable and possible that the recesses, at their lateral edges, respectively incorporate undercuts which, upon the insertion of the marking strip into the groove, produce a form-fitted connection, such that the marking strip is retained in the groove in a form-fitted manner. To this end, the marking strip, in cross-section, can assume a conically-tapering and trapezoidal form in the direction of placement, which facilitates the insertion of the marking strip into the groove.

In order to produce a compact and easy-to-handle assembly, the electrical devices, for example in the form of series terminals, can be arranged side by side in a row, for example on a carrier strip which extends along the longitudinal direction. The carrier strip constitutes a transport mounting, of the type described in DE 10 2013 112 789 A1. By means of the carrier strip, to which the individual electrical devices are attached in a form-fitted manner by means of associated attachment devices, a combination of electrical devices is provided, which can be held by a user and, for example, inserted in an automatic machine for the population of a support rail. The electrical devices, for example series terminals, can be of identical design, but can also be of differing design, provided that the marking fields of the individual electrical devices, where said electrical devices are arranged side by side in a row, connect to one another and form a continuous row, to which the marking strip can be applied.

In an original state, the marking strip is configured as a continuous strip, in which the marking labels can be mutually connected by various means.

Thus, according to a first variant, the marking labels, in an original state, can be connected to one another by means of a fixing strip, wherein the fixing strip is detachable from the marking labels, in order to separate the marking labels. The marking strip—with the marking labels mutually connected by means of the fixing strip—can thus be applied to the row of marking fields of the electrical devices, such that the marking labels, for example, are adhered to the electrical devices. Once the marking strip is arranged on the electrical devices, the fixing strip can be removed, wherein the marking labels remain on the electrical devices, and said electrical devices are thus equipped with inscribable marking labels.

In a further, second variant, the marking labels, in the original state, can also be integrally interconnected. In this case, the marking labels can be separated from one another, for example wherein the marking labels are mutually divided along separating lines formed on the marking strip. The separating lines can be formed on the marking strip, for example, by the deliberate weakening of the material, for example by perforation, or by the thinning of the material. Along the separating lines, adjoining marking labels can be separated from one another, which can be achieved by means of an appropriate tool, or can also be achieved automatically upon the mutual separation of the electrical devices.

If, by means of the method described, the electrical devices in the assembly have been equipped with marking labels, electrical devices can be fitted to a support rail, either individually or in combination, such that said support rail is populated and, in this manner, an electrical installation is provided, for example within a switchgear cabinet. To this end, an electrical device can be removed from the assembly of electrical devices arranged side by side in a row, and fitted to the support rail. The marking label of the electrical device thus removed and fitted to the support rail can then be inscribed by means of a laser inscription device such that, in this manner, for example, the function and/or the connections of the electrical device can be identified.

On the support rail, entirely different electrical devices of entirely different design can be mutually combined. By means of the laser inscription device, marking labels of the various electrical devices can be inscribed—this can be executed with electrical devices already fitted to the support rail.

In an embodiment, the present invention provides a marking strip for attachment to a row of marking fields on a plurality of electrical devices that can be arranged side by side in a row on a support rail. A marking strip of this type comprises a plurality of marking labels which, in an original state, are connected to one another, are to be separated, and are inscribable by means of a laser inscription device. As the marking strip can be applied in its entirety to the row of marking strips on electrical devices arranged side by side in a row, the electrical devices, in a single working step, can be equipped with marking labels, which can be inscribed thereafter by laser inscription. Each marking label on the marking strip can, for example, incorporate an adhesive layer for attachment to a marking field of an electrical device. By means of the adhesive layer, any given marking label can be applied to an associated marking field on an electrical device, and thus adhered to said marking field.

The marking labels on the marking strip are inscribable using a laser inscription device. By means of the laser inscription device, a laser beam can be directed onto a marking label such that, in this manner, a predefined and individual identification marking can be applied to the marking label.

The marking labels can comprise a single-layer base structure of a laser-inscribable material. In this case, the material itself is altered by laser inscription, such that a color change is triggered in the material. Alternatively, a multi-layered base structure can be employed, wherein a top coat is applied to a base material, which can be removed by means of a laser beam, such that an inscription is formed accordingly.

In an original state, the marking strip is configured as a continuous strip. In the original state, according to a first variant, the marking labels of the marking strip are connected to one another by means of a fixing strip, wherein the fixing strip can be removed from the marking labels, for the separation of said marking labels.

The fixing strip, in the original state, is preferably arranged on a first side of the marking labels, which is averted from a second side, by means of which the marking labels can be secured to the electrical devices. Once the marking strip has been applied to the electrical devices, the fixing strip can be removed from the marking labels, such that the marking labels are separated from one another, and the individual electrical devices are equipped with separate marking labels.

In a second variant, the marking labels, in the original state, are integrally joined to one another, and can be separated from one another along separating lines. The separating lines can be formed in the marking strips, for example, by the deliberate weakening of material, for example by perforation or by the thinning of material, such that the marking labels can be torn from one another along the separating lines. In this second variant, an (additional) fixing strip for the connection of the marking labels can thus be omitted. In an original state, the marking labels are integrally interconnected. The separation of the marking labels can be executed automatically, for example upon the separation of the electrical devices from one another, without the necessity for an additional working step for this purpose.

In an embodiment, the present invention provides an assembly having a plurality of electrical devices that can be arranged on a support rail, each having a marking field to which a marking label can be secured. The electrical devices are arranged side by side in a row along a longitudinal direction, such that the marking fields of the electrical devices connect to one another along the longitudinal direction, and form a continuous row extended along the longitudinal direction. It is thus provided that a marking strip, having a plurality of separable marking labels which are associated with the marking fields of the electrical devices and which can be inscribed using a laser inscription device, is attached along the row of electrical devices.

The assembly is preferably formed as an intermediate product, by means of the above-described method. Thus, further to the application of the marking strip, the electrical devices with marking labels arranged thereupon are provided, wherein the marking labels may or may not be previously separated by the removal of a fixing strip, or by the separation of the marking fields from one another along separating lines. The assembly of electrical devices can, for example, be arranged on a carrier strip, thereby constituting a compact assembly which can be handled in a simple manner.

The assembly can, for example, be delivered by a manufacturer of electrical devices to an end user, wherein the inscription of the marking labels of the electrical devices can be executed by the end user, further to the fitting of said electrical devices to a support rail.

Figure 2A:
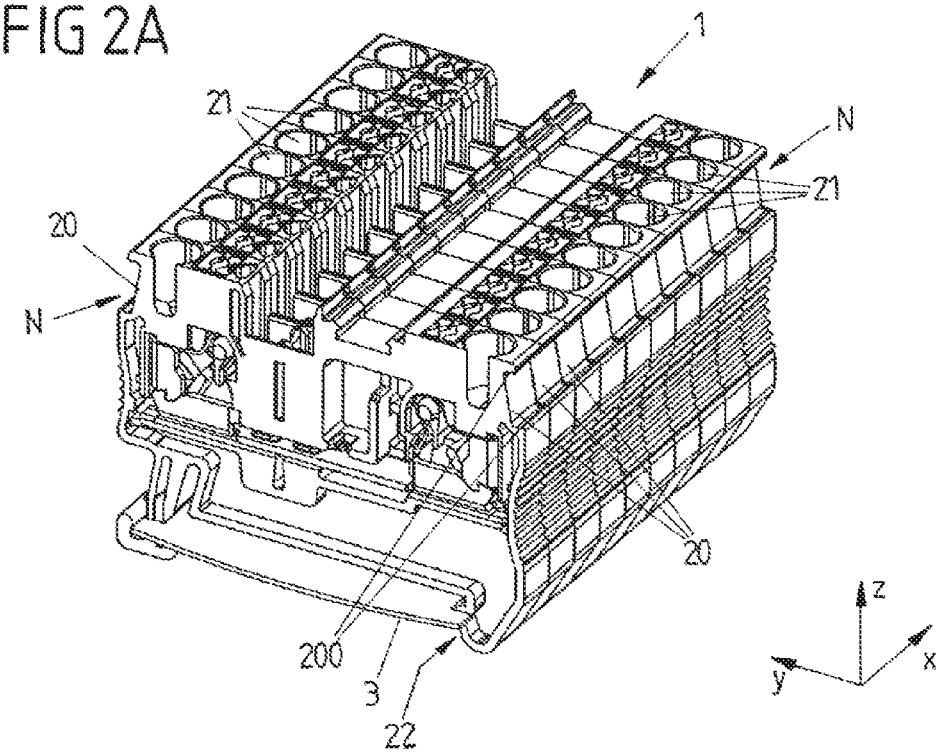
FIG. 2A shows a view of an assembly of electrical devices according to a second exemplary embodiment.

FIGS. 1A and 2A show different exemplary embodiments of electrical devices 2 in the form of series terminals, which incorporate plug-in locations 21 for the plug-in of electrical conductors, and permit the contacting and mutual interconnection of electrical conductors. The electrical devices 2 can be fitted to a support rail 6 in a form-fitted manner by means of an attachment device 22, as represented in an exemplary manner in FIG. 3, and can be combined on the support rail 6 with other electrical devices 2, for example further series terminals or electronic devices which, for example, assume control or automation functions in the context of an industrial installation.

By the arrangement of electrical devices 2 on a support rail 6, an electrical installation can be provided, for example within a switchgear cabinet. On the support rail 6, electrical devices 2 can be arranged in a modular manner, with a wide variety of variants for the mutual combination of entirely different electrical devices 2.

The exemplary embodiments according to FIGS. 1A and 2A differ with respect to the dimensioning of the electrical devices 2 in the form of series terminals, but are otherwise identical in function.

In FIGS. 1A and 2A, the electrical devices 2 in the form of series terminals are mutually combined to form an assembly 1, wherein electrical devices 2 of identical design are arranged on a transport mounting in the form of a carrier strip 3. By means of the carrier strip 3, the electrical devices 2 are connected to one another, such that the electrical devices 2 can be handled in a simple manner and, for example, transported. This is described in detail in DE 10 2013 112 789 A1, the content of which is to be considered in relation hereto.

Figure 3:
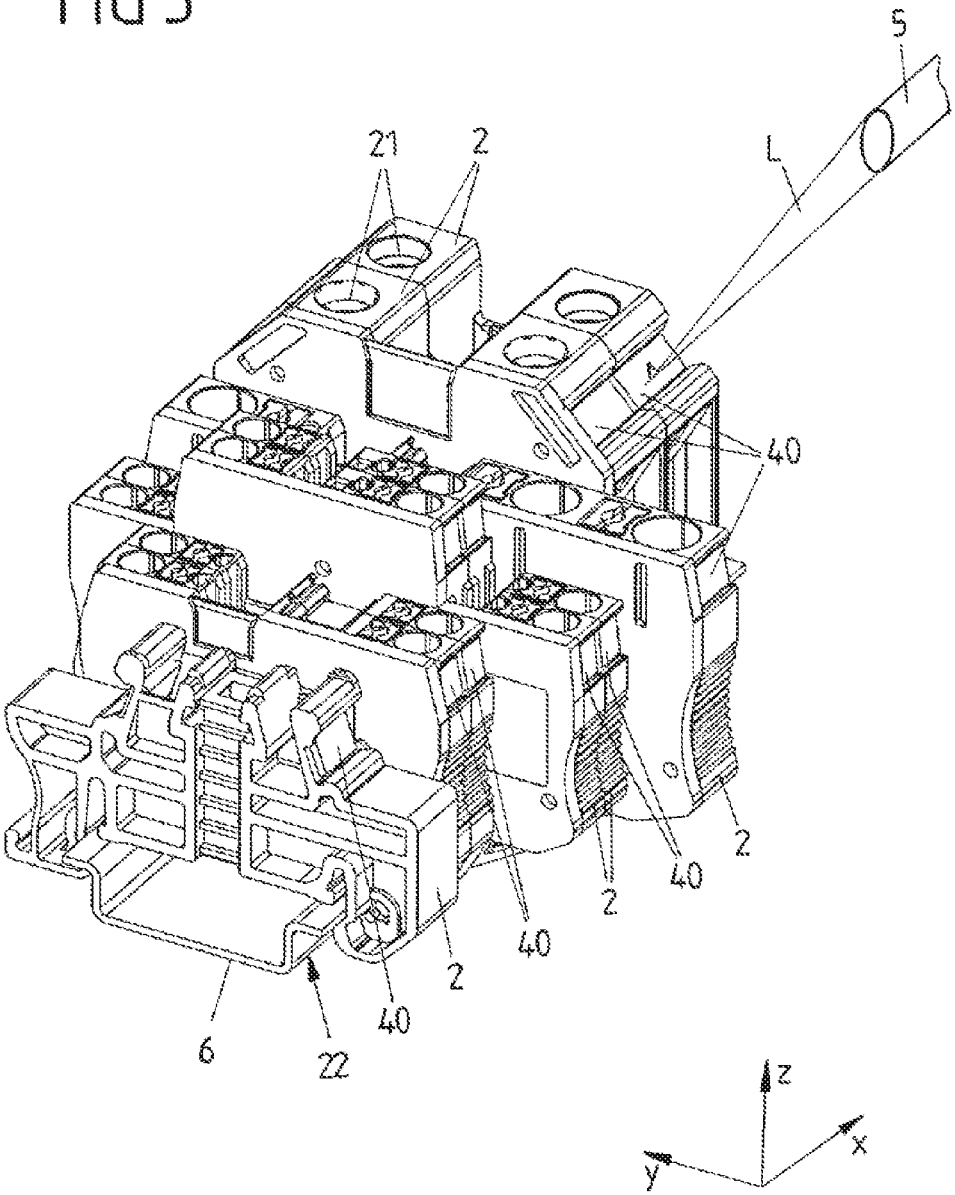
FIG. 3 shows a view of different electrical devices fitted to a support rail.

The electrical devices 2—where they are mutually combined on a support rail 6 for the constitution of an electrical installation, as represented in FIG. 3—are to be identified by means of inscribed marking labels 40. This permits the distinction of electrical devices 2 from one another, in the interests, for example, of identifying predefined plug-in locations 21 for electrical conductors.

Conventionally, for example, it is customary for marking labels 40 to be inscribed, and applied thereafter to the electrical devices 2 which are already fitted to the support rail 6, thus permitting the identification of said electrical devices 2. The marking labels 40 can be individually inscribed here, for example by the manufacturer of the electrical devices 2, and the inscribed marking labels 40 can be supplied together with the electrical devices 2 (but still separated from the latter). However, the application of the marking labels 40 to the electrical devices 2 then requires a substantial degree of manual labor, in order to apply individual marking labels 40 to the already fitted electrical devices 2.

In a departure from this hitherto customary concept, it is proposed herein that the marking labels 40 firstly be applied to the electrical devices 2 in an uninscribed state, and not inscribed by means of a laser inscription device 5 until the electrical devices 2 have been fitted to the support rail 6. The electrical devices 2 are thus already provided with (uninscribed) marking labels 40 which are arranged thereupon, are arranged on the support rail 6, and are then individually inscribed by means of the laser inscription device 5, after fitting to the support rail 6.

As a result of the disparity of the electrical devices 2 fitted to the support rail 6, the marking labels 40 are not located in a single plane. By the employment of a laser inscription device 5, which generates a flexibly-controllable and directionally-adjustable laser beam L for inscription purposes, a contactless inscription of the marking labels 40 arranged in different inscription planes can be executed in a simple and reliable manner.

For the application of the marking labels 40, electrical devices 2, as represented in FIGS. 1A and 2A, are firstly combined in an assembly 1, wherein this assembly 1, in the exemplary embodiment represented, is bonded together by means of a carrier strip 3, such that the electrical devices 2 are maintained in position in relation to one another. In the context of this assembly 1, the electrical devices 2 are arranged side by side in a row along a longitudinal direction X, such that marking fields 20 of the electrical devices 2 connect to one another along the longitudinal direction X and form a continuous row, extended along the longitudinal direction X.

Figure 1B:
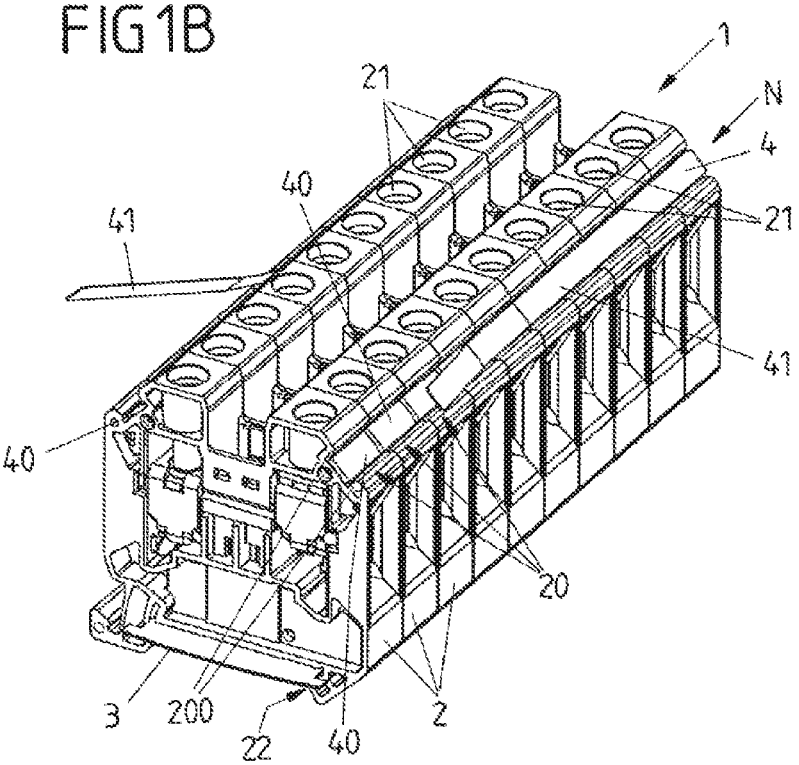
FIG. 1B shows a view of the assembly, with marking strips applied to the electrical devices.
Figure 2B:
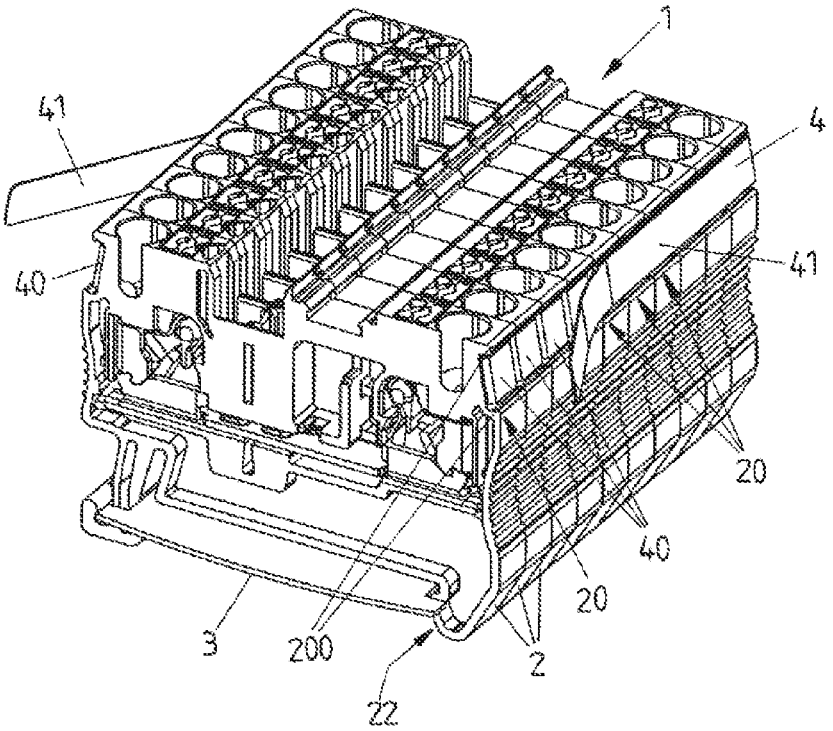
FIG. 2B shows a view of an assembly after the application of marking strips.

By the arrangement of the marking fields 20 on the base of recesses in the electrical devices 2, a continuous groove N, extending in the longitudinal direction X, is constituted in the assembly 1. In this groove N, as represented in FIGS. 1B and 2B, a continuous marking strip 4 can be inserted, wherein the marking strip 4 is adhered to the row of marking fields 20.

Additionally, on lateral edges of the groove N, undercuts 200 are configured such that, upon the insertion of the marking strip 4 into the groove N, a form-fitted connection is formed between the marking strip 4 and the undercuts 200. To this end, the marking strip 4, in a transverse cross-section to the longitudinal direction X, can assume a tapering trapezoidal form in the direction of placement, which facilitates the insertion of the marking strip 4 into the groove N.

In the exemplary embodiments represented, the electrical devices 2 each incorporate two mutually-opposing marking fields 20 which, upon the side-by-side arrangement in a row for the constitution of the assembly 1, constitute two mutually-opposing grooves N, into each of which a marking strip 4 can be inserted.

As represented in two exemplary embodiments in FIGS. 4A, 4B and 5A, 5B, the marking strip 4 incorporates marking labels 40, arranged side by side in a row along the longitudinal direction X, which, on a first side, are connected to one another by means of a fixing strip 41 and, on a second side which is averted from the first side, carry an adhesive layer 402, by means of which the individual marking labels 40 can be adhered to associated marking fields 20 on the electrical devices 2. The exemplary embodiments according to FIGS. 4A, 4B and 5A, 5B differ with respect to the division of the marking labels 40 along the longitudinal axis X: the exemplary embodiment according to FIGS. 4A, 4B features a comparatively small division, with short marking labels 40 in the longitudinal axis X, and is thus appropriate for comparatively narrow electrical devices 2. Conversely, the exemplary embodiment according to FIGS. 5A, 5B features a comparatively large division in the longitudinal direction X, with comparatively long marking labels 40 in the longitudinal direction X.

In an original state, the marking labels 40 are connected to one another by means of the fixing strip 41, such that a continuous marking strip 4 is provided. However, the marking labels 40 are, in principle, constituted individually here, and are individually attached to the fixing strip 41. The fixing strip 41 is detachable, such that the marking labels 40 can be separated by the removal of the fixing strip 41.

Thus, as represented in FIGS. 1B and 2B, further to the fitting of the marking strip 4 in the associated groove N in the assembly 1 of the electrical devices 2, the fixing strip 41 can be removed, as a result of which the marking labels 40 on the electrical devices 2 are separated. One marking label 40 is assigned to each marking field 20 on an electrical device 2 such that, further to the removal of the fixing strip 41, a marking label 40 remains on each marking field 20.

Figure 1C:
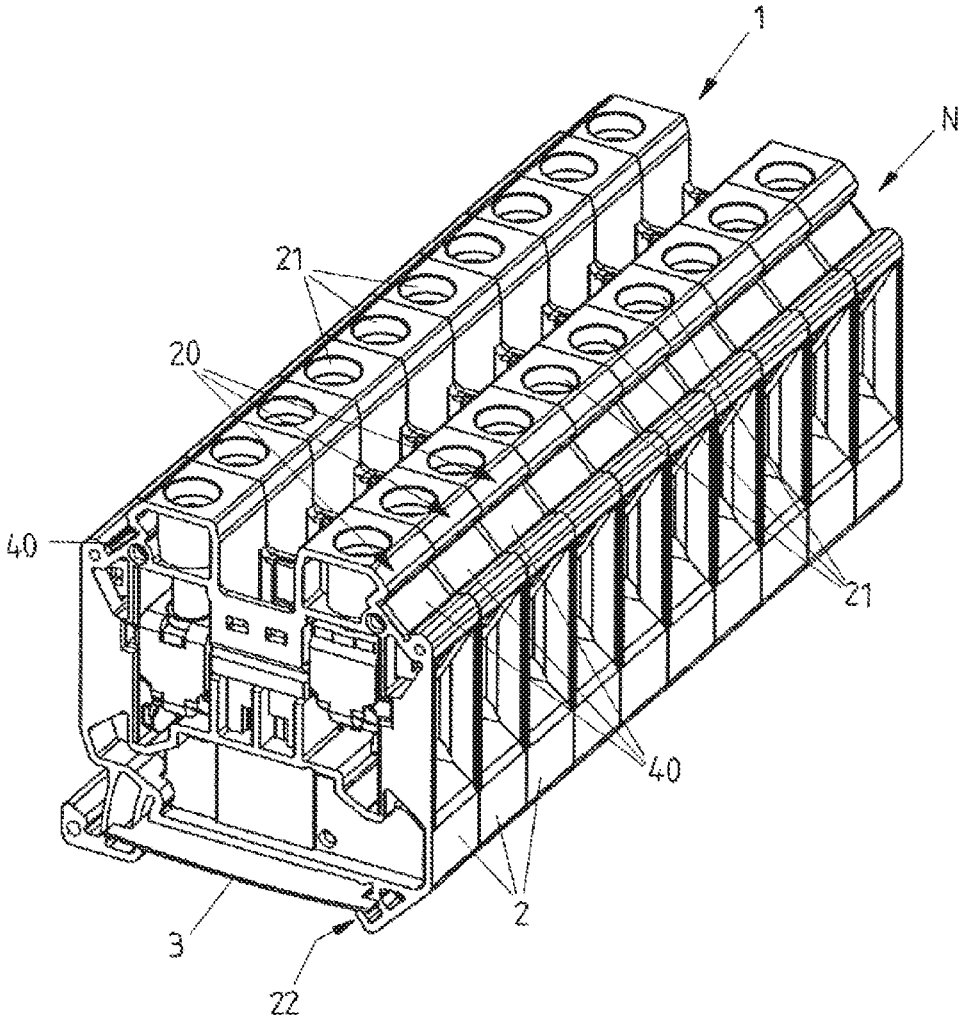
FIG. 1C shows a view of the assembly after the separation of marking labels of the marking strips.
Figure 2C:
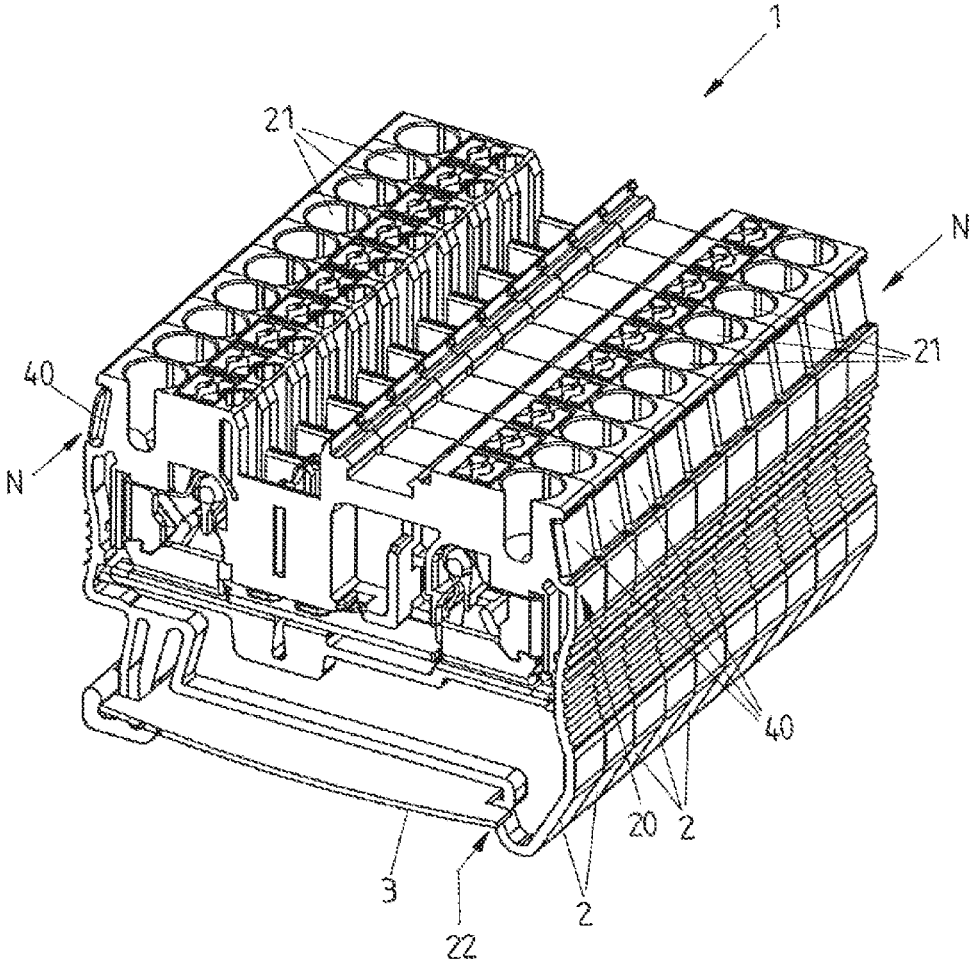
FIG. 2C shows a view of the assembly after the separation of the marking labels.

After the removal of the fixing strip 41, the assembly 1 of electrical devices 2 is constituted, having inscribable marking labels 40 arranged on the marking fields 20, as represented in FIGS. 1C and 2C.

Figure 4A:
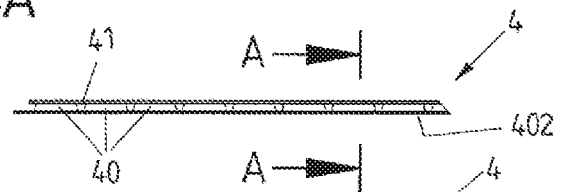
FIG. 4A shows a side view of a first exemplary embodiment of a marking strip.
Figure 4B:
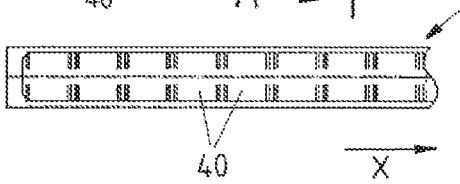
FIG. 4B shows an overhead view of the marking strip.
Figure 5A:
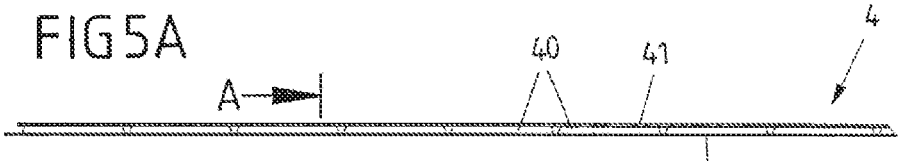
FIG. 5A shows a side view of another exemplary embodiment of a marking strip, with a larger division.
Figure 5B:
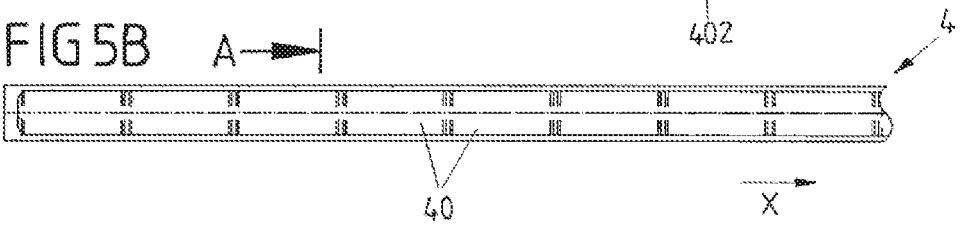
FIG. 5B shows an overhead view of the marking strip according to FIG. 5A.
Figure 6:
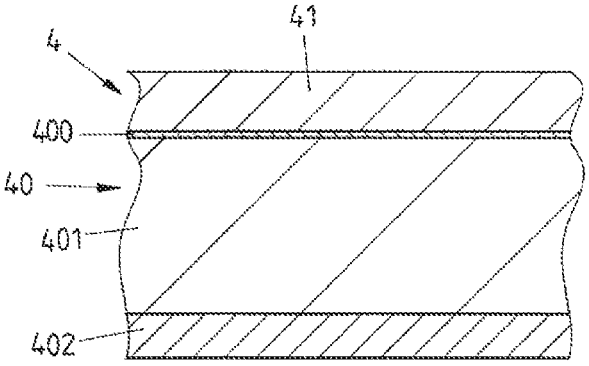
FIG. 6 shows a sectional view along line A-A, as represented in FIGS. 4A and 5A.

FIG. 6 shows a cross-sectional view of the marking strip 4 according to FIGS. 4A and 5A, along line A-A. Each marking label 40 is comprised of a base layer 401 which, in the exemplary embodiment represented, is provided with a top layer 400 on the side which faces the fixing strip 41, and carries an adhesive layer 402 on the side which is averted from the fixing strip 41. In the original state, the fixing strip 41 is arranged on the top layer 400, and the marking labels 40 are connected to one another by means of the fixing strip 41. Additionally, prior to the fitting of the marking strip 4 in the respectively associated groove N, a protective film can be applied to the adhesive layer 402, in order to prevent any unwanted adhesion of the marking labels 40.

The marking labels 40, as schematically represented in FIG. 3, are laser-inscribable. To this end, a laser beam L of a laser inscription device 5 can be directed onto an individual marking label 40, in order to permit the individual inscription of the marking label 40 of an electrical device 2 which is already fitted to a support rail 6. In the context of laser inscription, by means of the laser beam L, areas of the top layer 400 are removed, wherein the top layer 400 and the base layer 401, for example, are of different coloration such that, by the removal of the top layer 400, an inscription is generated by the contrast between the different colorations of the top layer 400 and the base layer 401.

In this context, it should be observed that entirely different laser-inscribable materials are available, which can comprise a single-layer or a multi-layer structure. In place of the two-layered exemplary embodiment (comprised of a top layer 400 and a base layer 401), for example, a single-layer material can also be employed, comprising a base layer 401 only. In this case, a laser beam L effects a material alteration in the base layer 401 which results in a color change, thereby generating an inscription.

As laser-inscribable materials, for example, polycarbonate (PC), polybutylene terephthalate (PBT) or acrylic butadiene styrene (ABS) can be employed. PC, for example, as a result of its carbon component, is directly laser-inscribable. A laser beam effects the carbonization of the material, thereby resulting in a change in color, which can be employed for the purposes of inscription. Where applicable, the materials can incorporate further additives, in the interests of superior laser-inscription properties.

According to the present concept, initially, a continuous marking strip 4 of separable marking labels 40 is arranged on an assembly 1 of electrical devices 2. The electrical devices 2 are preferably of identical design, and thus of identical dimensions, such that, by the arrangement of the electrical devices 2 side by side in a row, a continuous row of marking fields 20 is constituted, upon which the marking strip 4 can be arranged. Further to the separation of the marking labels 40 by the removal of the fixing strip 41, the assembly 1 can be inserted, for example, in an automatic placement machine for the population of a support rail 6, such that individual electrical devices 2 can be removed and fitted to a support rail 6. After fitting to the support rail 6, the individual inscription of the marking labels 40 applied to the electrical devices 2 can then be executed.

Accordingly, the inscription is preferably executed with the electrical devices 2 already fitted to the support rail 6.

In its original state, the marking strip 4 is continuous, and comprises marking labels 40 arranged side by side in a row which are separable, in order to permit the assignment of individual marking labels 40 to individual electrical devices 2. The employment of a fixing strip 41 is not essential here—the marking labels 40, in the original state of the marking strip 4, can also be connected to one another by other means, but are likewise separable.

Further exemplary embodiments of a marking strip 4 are represented in FIGS. 7A, 7B and 8A, 8B, wherein these two exemplary embodiments—analogously to the exemplary embodiments according to FIGS. 4A, 4B and 5A, 5B—only differ with respect to the division of the marking labels 40 along the longitudinal direction X. Thus, the exemplary embodiment according to FIGS. 7A, 7B features a comparatively small division, with short marking labels 40 (measured in the longitudinal direction X). Conversely, the exemplary embodiment according to FIGS. 8A, 8B features a comparatively large division, with long marking labels 40 in the longitudinal direction X.

In the exemplary embodiments according to FIGS. 7A, 7B, 8A, 8B, the marking labels 40, in the original state, are integrally connected to one another, thereby constituting an integrated and continuous marking strip 4.

Figure 9:
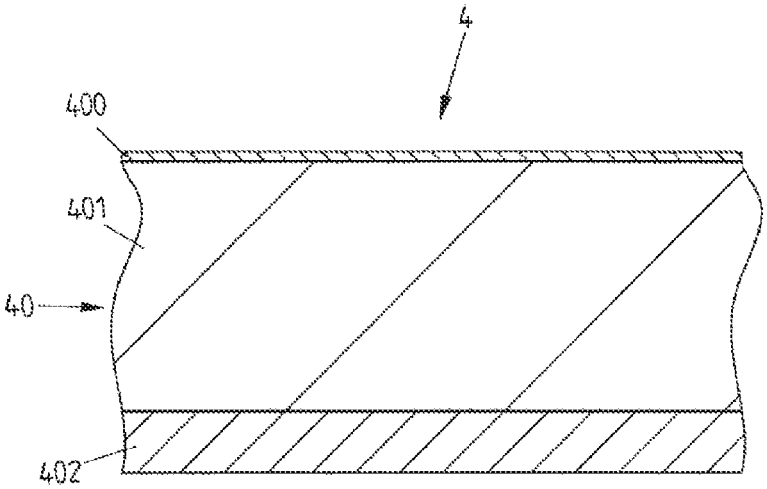
FIG. 9 shows a cross-sectional view along line A-A, as represented in FIGS. 7A and 8A.
Figure 10:
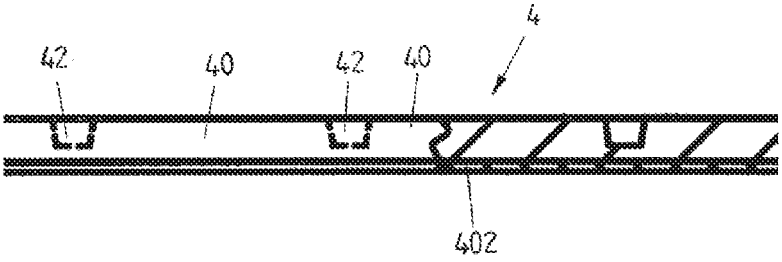
FIG. 10 shows an enlarged view of section C, as represented in FIG. 7A.

The fundamental design of the individual marking labels 40, as can be seen from the sectional view represented in FIG. 9, is identical to the design of the marking labels 40 in the exemplary embodiment according to FIGS. 4A, 4B and 5A, 5B, wherein, however, in the original state, no fixing strip 41 (as represented in the sectional view according to FIG. 6) is present. The marking labels 40, in the original state, are integrally connected to one another, as can be seen from the enlarged representation according to FIG. 10.

Although the marking labels 40, in the original state, are integrally connected to one another, they are structurally subdivided by means of separating lines 42 formed in the marking strip 4, and are thus separable. Along the separating lines 42, the individual marking labels 40 can be divided from one another, and are thus separated, which can be executed by means of a (cutting) tool, or by the tearing of the marking strip 4 along the separating lines 42, in conjunction with the separation of the electrical devices 2 of the assembly 1.

Figure 7A:
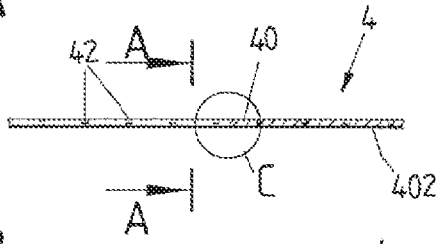
FIG. 7A shows a partial sectional side view along line B-B, as represented in FIG. 7B, of a further exemplary embodiment of a marking strip.
Figure 7B:
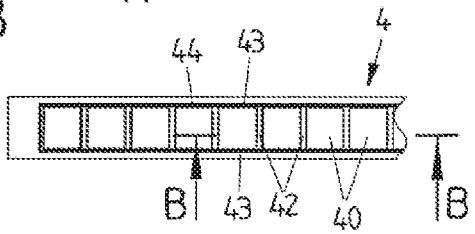
FIG. 7B shows an overhead view of the marking strip.
Figure 8A:
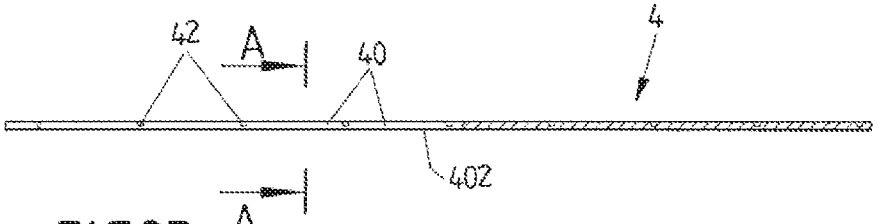
FIG. 8A shows a partial sectional side view along line B-B, as represented in FIG. 8B, of a further exemplary embodiment of a marking strip, with a larger division in comparison with the marking strip represented in FIGS. 7A and 7B.
Figure 8B:
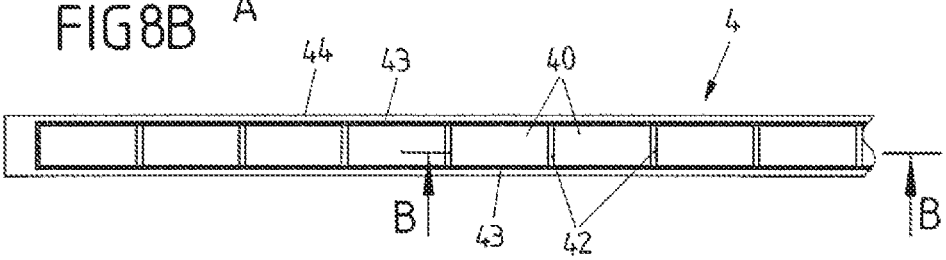
FIG. 8B shows an overhead view of the marking strip.

As can be seen in the overhead views according to FIGS. 7B and 8B, the marking labels 40, in the original state, can be surrounded by surplus material 44 which, by means of separating lines 43 formed in the marking strip 4, is structurally separated from the marking labels 40. An adhesive layer 402 is only provided here on the marking labels 40, but not on the surplus material 44, such that the surplus material 44, before or after the adhesion of the marking strip 4 to the assembly 1 of electrical devices 2, can be removed in a simple manner by tearing along the separating lines 43.

The fundamental concept of the invention is not restricted to the exemplary embodiments described above, but can also, in principle, be realized in an entirely different manner.

Specifically, entirely different laser-inscribable materials can be employed for the realization of the marking labels. These materials can be of a single-layer or multi-layer structure.

If a fixing strip is provided for the connection of the marking labels to one another in the original state, this fixing strip is detachable from the marking labels in a simple manner, without leaving any adhesive residues on the marking labels. To this end, a weakly-bonding adhesive can be employed for the attachment of the fixing strip to the marking labels in the original state.

Conversely, the adhesive layer for the bonding of the marking labels to the electrical devices is of the strongly-bonding type, and thus provides a permanent bond between the individual marking labels and their associated marking fields on the electrical devices.

The electrical devices can be of entirely different type. For example, the electrical devices can be realized in the form of series terminals. It is also conceivable and possible, however, that the electrical devices are realized in the form of electronic devices comprising, for example, a circuit board with electronic components arranged thereupon.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SYMBOLS

1 Assembly
2 Electrical device (series terminal)
20 Marking field
200 Undercut
21 Contact point
22 Attachment device
3 Carrier strip
4 Marking strip
40 Marking label
400 Top layer
401 Base layer
402 Adhesive layer
41 Fixing strip
42, 43 Separating line
44 Surplus material
5 Laser inscription device
6 Support rail
L Laser beam
N Groove
X, Y, Z Direction

The invention claimed is:

1. A method for populating a support rail with electrical devices, comprising:

providing a plurality of electrical devices, each having a marking field to which a marking label is attachable;

arranging the electrical devices side by side in a row along a longitudinal direction to provide an assembly, such that the marking fields of the electrical devices connect to one another along the longitudinal direction and form a continuous row extended along the longitudinal direction;

attaching a marking strip having a plurality of marking labels, which are inscribable using a laser inscription device, along the row of electrical devices;

removing at least one electrical device from the assembly of electrical devices arranged side by side in a row;

fitting the at least one electrical device to a support rail; and inscribing at least one marking label attached to the at least one electrical device thus removed and fitted to the support rail, using a laser inscription device.

2. The method of claim 1, wherein the marking strip is adhered to the electrical devices along the row of marking fields.

3. The method of claim 1, wherein the marking fields comprise recesses on the electrical devices and, by the arrangement of the electrical devices side by side in the row, a continuous groove is formed, extending in the longitudinal direction, into which the marking strip is secured.

4. The method of claim 3, wherein the marking strip is secured in the groove in a form-fitted manner.

5. The method of claim 1, wherein the electrical devices, for the assembly, are arranged side by side in the row on a carrier strip which extends along the longitudinal direction.

6. The method of claim 1, wherein the marking labels, in an original state, are connected to one another by a fixing strip, and are separated by removal of the fixing strip.

7. The method of claim 1, wherein the marking labels, in an original state, are integrally interconnected, and are configured to be separated from one another by mutually dividing the marking labels along separating lines formed on the marking strip.

* * * * *